US008869782B2

(12) United States Patent
Blackman et al.

(10) Patent No.: US 8,869,782 B2
(45) Date of Patent: Oct. 28, 2014

(54) INFLATABLE LIFE PRESERVER AND ASSOCIATED DELIVERY SYSTEM

(71) Applicant: Carleton Technologies, Inc., Orchard Park, NY (US)

(72) Inventors: Donald Blackman, Bradenton, FL (US); M. Elizabeth Bolint, Tampa, FL (US); Brian Ford, Seminole, FL (US); David A. Sapio, St. Petersburg, FL (US)

(73) Assignee: Carleton Technologies, Inc., Orchard Park, NY (US)

( * ) Notice: Subject to any disclaimer, the term of this patent is extended or adjusted under 35 U.S.C. 154(b) by 61 days.

(21) Appl. No.: 13/790,818

(22) Filed: Mar. 8, 2013

(65) Prior Publication Data

US 2013/0247892 A1 Sep. 26, 2013

Related U.S. Application Data

(60) Provisional application No. 61/608,989, filed on Mar. 9, 2012.

(51) Int. Cl.

| | |
|---|---|
| ***F41B 11/80*** | (2013.01) |
| ***B63C 9/08*** | (2006.01) |
| ***B63C 9/22*** | (2006.01) |
| *B63C 9/00* | (2006.01) |

(52) U.S. Cl.

CPC ..... *B63C 9/081* (2013.01); *F41B 11/80* (2013.01); *B63C 9/22* (2013.01); *B63C 9/082* (2013.01); *B63B 2231/40* (2013.01); *B63B 2231/50* (2013.01); *B63B 2241/10* (2013.01); *B63C 2009/0041* (2013.01)

USPC ..... 124/71; 124/56

(58) Field of Classification Search

USPC ..... 124/71, 56; 441/88, 98, 97

See application file for complete search history.

(56) References Cited

U.S. PATENT DOCUMENTS

| | | | | |
|---|---|---|---|---|
| 831,891 | A | 9/1906 | Quarterman | |
| 3,496,580 | A | 2/1970 | Gulmon | |
| 3,505,926 | A * | 4/1970 | Johnson | 89/1.34 |
| 3,777,692 | A * | 12/1973 | Baccaglini et al. | 114/54 |
| 4,341,030 | A * | 7/1982 | Little | 42/105 |
| 4,713,033 | A * | 12/1987 | Cameron | 441/84 |
| 4,799,906 | A | 1/1989 | Perkins, Jr. | |
| 5,584,736 | A | 12/1996 | Salvemini | |
| 5,775,966 | A | 7/1998 | Bautista Real et al. | |
| 6,080,027 | A * | 6/2000 | Rodemann | 441/41 |
| 6,379,207 | B1 | 4/2002 | Castagner et al. | |

(Continued)

FOREIGN PATENT DOCUMENTS

| | | | |
|---|---|---|---|
| WO | 9854539 | A | 12/1998 |
| WO | 0102245 | A | 1/2001 |

*Primary Examiner* — Michael David

(74) *Attorney, Agent, or Firm* — Jaeckle, Fleischmann & Mugel, LLP

(57) ABSTRACT

Disclosed is an inflatable article that is designed to be launched to an intended target. The article is launched by a gun in an un-inflated state and inflates upon contacting water. The target can be, for example, a person being rescued. The article is initially stored in an outer layer of material. The outer layer of material may be shrink-wrap or a foam layer. The outer layer permits the article to be retained in a compact configuration prior to being launched. This, in turn, allows the article to be launched over great distances. The outer layer is designed to rupture upon inflation of the article.

8 Claims, 5 Drawing Sheets

(56) References Cited

U.S. PATENT DOCUMENTS

| | | | | |
|---|---|---|---|---|
| 6,533,626 | B2 * | 3/2003 | Pons | 441/80 |
| 7,004,807 | B1 * | 2/2006 | Summers | 441/81 |
| 7,128,629 | B2 | 10/2006 | Summers | |
| 7,530,873 | B1 * | 5/2009 | Chang | 441/89 |
| 8,469,015 | B2 * | 6/2013 | Gerwig | 124/57 |
| 8,601,928 | B2 * | 12/2013 | Martinez et al. | 89/1.34 |
| 2006/0148346 | A1 | 7/2006 | Summers | |
| 2012/0073677 | A1 * | 3/2012 | Clark et al. | 137/455 |

* cited by examiner

INFLATABLE LIFE PRESERVER AND ASSOCIATED DELIVERY SYSTEM

RELATED APPLICATION DATA

This application claims priority to application Ser. No. 61/608,989 filed on Mar. 9, 2013 and entitled "Inflatable Life Preserver and Associated Delivery System." The contents of this co-pending application are fully incorporated herein.

BACKGROUND OF THE INVENTION

1. Field of the Invention

The present invention relates to a life preserver and in particular to an inflatable life preserver with an associated delivery system.

2. Description of the Background Art

There are a wide variety of inflatable life preservers in use today. An example of one such life preserver is disclosed in U.S. Pat. No. 5,775,966 to Bautista Real et al. Real '966 discloses a life saving float with an associated launcher. The launcher takes the form of a gun that is designed to fire the float at an individual in distress. Upon firing the gun, a lever is activated that causes the float to be automatically inflated. The float begins to inflate as soon as the gun is fired.

Another example of a life preserver is disclosed in U.S. Pat. No. 7,128,629 to Summers. Summers '629 discloses a throwable emergency response device that automatically inflates. The device is adapted to be thrown to a person in a body of water. The device is provided in a substantially baton-shaped configuration. A flotation bladder is included at one end of the handle. An inflator assembly is included within the cylinder to automatically activate upon contact with the water. Once activated, the inflator releases pressurized gas and rapidly fills an inflation bladder.

Each of the foregoing life preservers suffers from a significant drawback. The device of Real '966, for example, suffers from the drawback that inflation begins when the user pulls the trigger on the gun. As a result, the projected article begins to be inflated prior to being launched. As the article expands during flight, aerodynamic drag increases and the distance traveled decreases. This prevents the device from being used to rescue individuals who are distant, and it otherwise prevents the accurate delivery of inflated article.

Summers '629 also suffers from significant drawbacks. Although it discloses an article that automatically inflates upon contacting the water, the device must be thrown by hand. Such a hand-thrown device, by definition, cannot travel great distances. The hand thrown device of Summer '629 also lacks accuracy in that the article, even in the un-inflated state, is not aerodynamic.

What is needed, therefore, is a life preserver that can be launched over great distances, that maintains a compact and aerodynamic configuration while being launched, and that automatically inflates upon contacting the water. The inflatable life preserver and delivery system of the present disclosure substantially fulfills this and other needs.

SUMMARY OF THE INVENTION

It is therefore an object of the present disclosure to create an inflatable life preserver that can be launched over great distances.

It is a further object of the present disclosure to provide a life preserver that is configured into a compact and/or aerodynamic shape prior to and during delivery to an intended target.

Yet another object of this disclosure is to permit a life preserver to maintain an uninflated and compact configuration until entry into a body of water.

Another object of this disclosure is to allow an uninflated life preserver to be launched by a user via a gun and to provide a mechanism for subsequently inflating the preserve only after entry into the water.

These and other objects of the disclosure are achieved by providing an inflatable article that is designed to be launched to an intended target. The target can be, for example, a person being rescued from the water. The article is preferably fired from a gun and is initially deflated and shaped into a compact configuration. The configuration permits the gun to propel the article over great distances. An outer layer of material can be included over the article. The outer layer of material can disintegrate upon contact with water, or in the alternative, the outer layer may rupture upon the article inflating. In either event, water is permitted to permeate the shrink wrap upon entry of the article into the water. When water contacts the article, an automatic inflator is activated. The inflator, in turn, delivers compressed air into the interior of the article to inflate it. Once inflated, the article can serve as a flotation device for the person being rescued.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claim.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

PARTS LIST

20 System
22 Air Gun
24 Inflatable Article
26 Gun Bore
28 Gun Handle
32 Gun Trigger
34 $CO_2$ Cylinder
36 Light
38 Shrink-Wrap
42 Gas Release Device
43 Gas Cylinder
44 Fully Inflated Article
46 Hand Holds
52 Alternative Article
54 Outer Foam Tube
56 End Caps
58 Apertures
62 Score lines
64 Plastic Netting
66 Manual Inflation Valve
68 Battery/Sensor
70 Strobe Light
72 Straps
73 Tape Strips
74 Cord Canister
76 Anchor Cord
78 Deployable Cord
82 Clips

DETAILED DESCRIPTION OF THE PREFERRED EMBODIMENT

The present disclosure relates to an inflatable article that is designed to be launched to an intended target. The article is launched by a gun in an un-inflated state and inflates upon contacting water. The target can be, for example, a person being rescued. The article is initially stored in an outer layer of material. The outer layer of material may be shrink-wrap or a foam layer. The outer layer permits the article to be retained in a compact configuration prior to being launched. This, in turn, allows the article to be launched over great distances. The outer layer may disintegrate upon contact with water, or in the alternative, the outer layer may rupture upon inflation of the article. In either event, water permeates the outer layer after the article lands in water. When water reaches the article through the outer layer, a water activated inflator is triggered. The inflator, in turn, fully inflates the article via a compressed gas. The act of inflation may serve to rupture the outer layer. Once fully inflated, the article can serve as a flotation device for the person being rescued. The various components of the present invention, and the manner in which they interrelate, are described in greater detail hereinafter.

Figure 1:
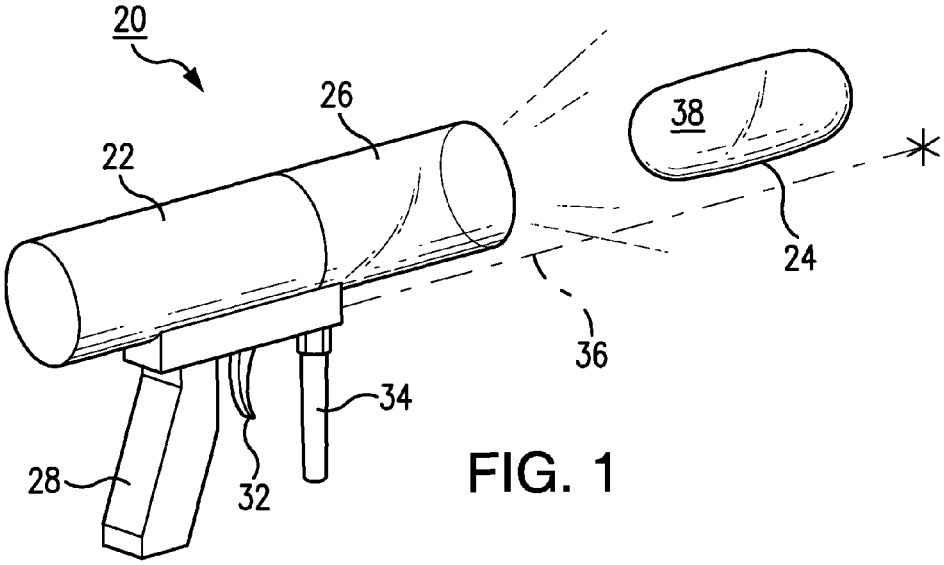
FIG. 1 is a prospective view of the gun launching the life preserver of the present invention.
Figure 2:
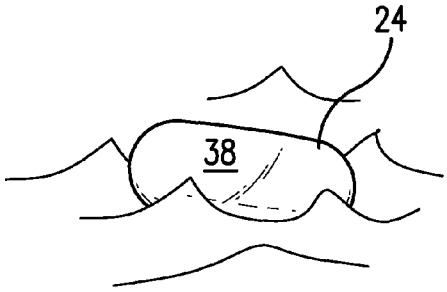
FIG. 2 is a depiction of the life preserver upon entry into the water and prior to inflation.
Figure 3:
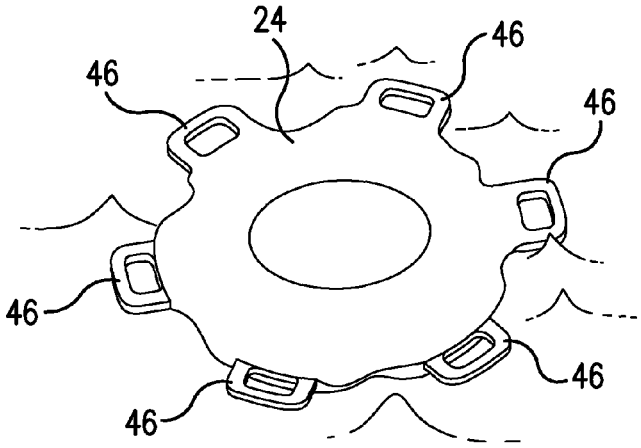
FIG. 3 is a depiction of the life preserver in its partially inflated state.

With reference now to FIG. 1, the overall system 20 is depicted. System 20 employs an air gun 22 that is specifically configured to launch an inflatable article 24. As explained in more detail hereinafter, inflatable article 24 is initially configured into a compact and/or aerodynamic shape. In the particular embodiment depicted in FIG. 1, article 24 is configured into an aerodynamic "bullet" shape. However, those of ordinary skill in the art will readily appreciate other compact and/or aerodynamic shapes into which article 24 can be configured. The objective is to create a shape which will permit article 24 to be propelled over long distance. For instance, article 24 can be formed into a football shape. The shape may optionally include rifling or other aerodynamic features. It is envisioned that, depending upon the size of the inflatable article 24 being delivered, article 24 could be launched 100 feet or more. This is a far greater distance than a preserver could be thrown by hand. It is also a far greater distance than an inflated preserver could be propelled. Article 24 can also be hand carried or belt worn prior to being launched by gun 22.

With continuing reference to FIG. 1, air gun 22 includes an enlarged cylindrical bore 26 that is dimensioned to receive inflatable article 24. Gun 22 further includes a handle 28 and trigger 32 to allow the user to appropriately aim and selectively discharge inflatable article 24. As noted, gun 22 is preferably an air gun that forcefully expels article 24 via the application of a highly pressurized gas. In this regard, article 24 fits within bore 26 via a tight, friction fit. This highly compressed gas can be air, carbon dioxide ($CO_2$), or Nitrogen ($N_2$). In the event compressed air is utilized, gun 22 may generate the needed compression via a spring or an electric motor pulling a piston. In the event compressed $CO_2$ is used, a cylinder 34 of compressed $CO_2$ is included. The construction and operation of $CO_2$ guns or "air guns" will be generally known to those of ordinary skill in the art. Furthermore, to increase the accuracy, gun 22 may include a laser light 36 or similar focused light beam to allow gun 22 to be correctly aimed. Light 36 can alternatively be a flash light to increase visibility during nighttime use. It may also be preferable to include multiple launchers in one device to allow multiple articles to be quickly delivered.

Article 24 is retained in a compact or aerodynamic shape via an outer layer of material. In the embodiment of FIG. 1, an outer layer of shrink-wrap 38 is used to package article 24. However, the use of non-shrink wrapped packaging is also within the scope of the invention. Shrink-wrap 38, which is also known as shrink film, is a material made up of a flexible, polymer based, plastic film. When heat is applied shrink-wrap shrinks tightly over whatever it is covering. When applied over deflated article 24, a very compact and tight configuration can be obtained. One suitable shrink-wrap film is Tyvek™ wrap. The shrink-wrap layer would be initially folded about the article and would protect initial components (such as batteries) of the article 24. Shrink-wrap 38 of the present disclosure must be water permeable. In this regard, shrink-wrapped material 38 can be perforated to allow for the passage of water. Such perforations should be small enough to permit the passage of water but not too large to interfere with the aerodynamics of article 24. In the alternative, shrink-wrap 38 can be made from a water dissolvable or water soluble material. Suitable water soluble plastic shrink wrap films are known to those skilled in the art. Whatever construction is utilized, the objective is to allow water to penetrate the shrink-wrap 38 following the entry of article 24 into the water.

The initial packing of article 24 may also include a piece of tubular foam (aka "pipe insulation"). This foam would be wrapped about article 24 prior to application of the shrink-wrap 38. The foam insulation would prevent a victim from being injured if they were hit by article 24 prior to deployment. The tubular foam also helps form a fluid tight seal between article 24 and bore 26; thereby permitting more pressure to be generated behind the device as it ejects and increasing the range. Holes are cross punched into the tubular foam so that water can contact the sensors of gas release device 42.

Figure 7:
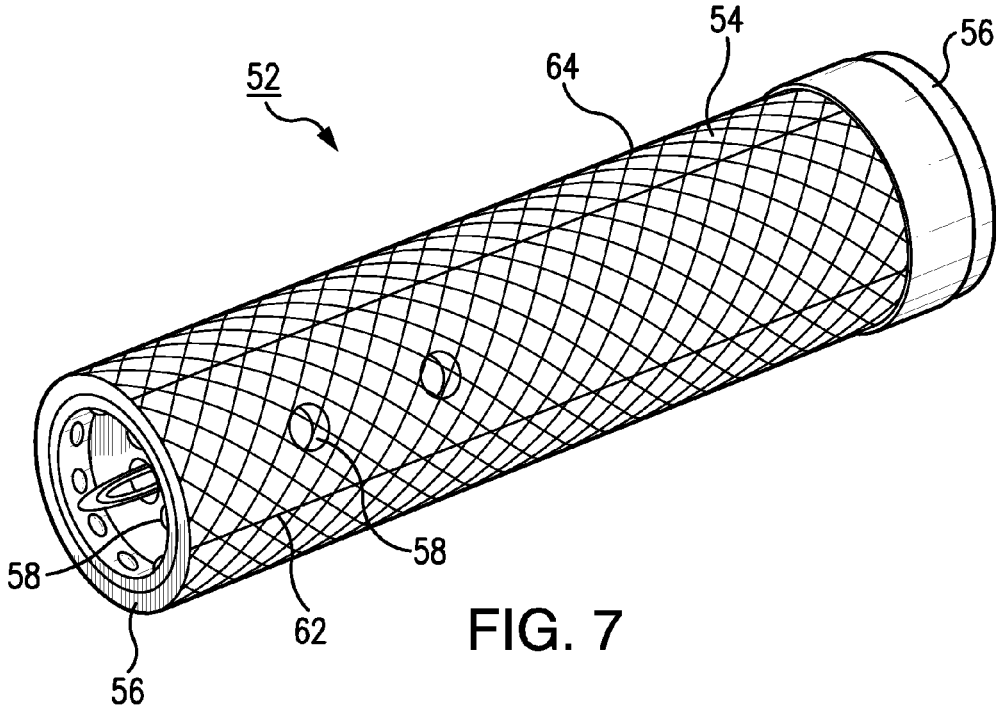
FIG. 7 is an alternative embodiment of a canister used to enclose the life preserver in its uninflated state.

An alternative article 52 is illustrated in FIG. 7. This configuration eliminates the use of shrink-wrap and instead uses an outer foam tube 54 to encase the deflated article. The foam is relatively rigid and takes on a tubular configuration. End caps 56 are secured over either end of foam tube 54. In the depicted embodiment, one of these caps 56 is secured via a series of peripheral clips and the other end cap 56 is secured via an adhesive. Apertures 58 are formed through the foam tube 54 as well as the end caps 56. Apertures 58 permit water to enter into tube 54 after article 52 contacts the water. One or more score lines 62 are preferably formed along tube 54. Score lines 62 allow the foam tube 54 to completely rupture as a result of the forces generated from the inflation of the interior article. Finally, as depicted, an outer layer of a plastic netting or mesh 64 can be secured over foam tube 54. Netting 64 allows tube 54 to retain its shape prior to and during deployment. Netting 64 is designed to rupture along with foam tube 54.

Figure 4:
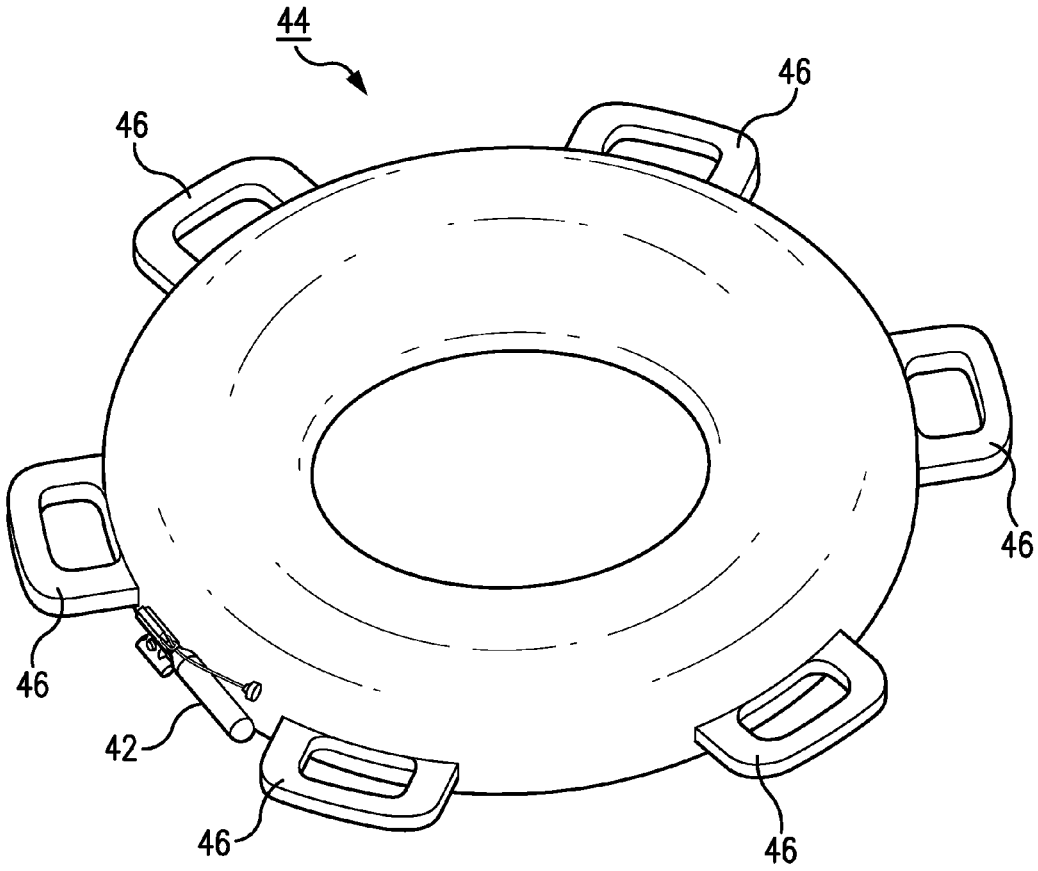
FIG. 4 is a depiction of the life preserver in its fully inflated state with an associated inflator attached thereto.

As noted in FIG. 4, inflatable article 24 includes a standard, water-activated, pressurized gas release device 42. Device 42 includes a cylinder 43 containing a compressed gas, as well as a battery and an associated sensor 68. Sensor 68 is triggered in the presence of water to release the pressurized gas from the cylinder to thereby inflate article (24 or 52) such that it attains a fully inflated form 44. Gas release device 42 is removably secured to article (24 or 52) in its deflated state via a standard Schrader valve on article (24 or 52). Such gas release devices are well known in the art. One suitable gas release device is disclosed in commonly owned U.S. patent application Ser. No. 13/231,682 to Clark, the contents of which are fully incorporated herein by reference. Pill activated inflators, which are known in the art, may also be used. Another suitable water-activated gas release device is disclosed in commonly owned U.S. Pat. No. 4,024,440 to Miller and assigned to Conax Corporation. The contents of this patent are fully incorporated herein for all purposes. Miller '440 discloses a system for automatically controlling the release of pressurized gas for inflating floatation equipment when dumped into the water. The device generally includes an electrically fireable primer for generating propulsion gas to drive a piercing pin into the closure of a container of pressurized gas. Once the container is punctured, the pressurized gas is used to fully inflate the inflation article. It is envisioned that the pressurized gas release device 42 can either store a compressed gas or it can create a gas by way of a chemical reaction. Both such systems are well known in the art and are within the scope of the present invention. Pressurized gas release device 42 may also include a cord for manually activating the device 42.

Figure 5:
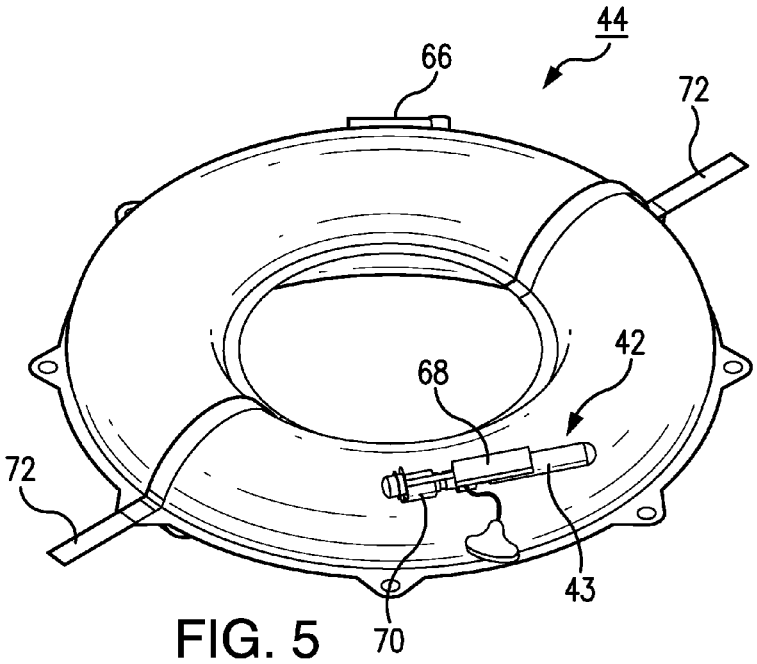
FIG. 5 is an additional view of the life preserver in its fully inflated state with the automatic inflator assembly visible.
Figure 6:
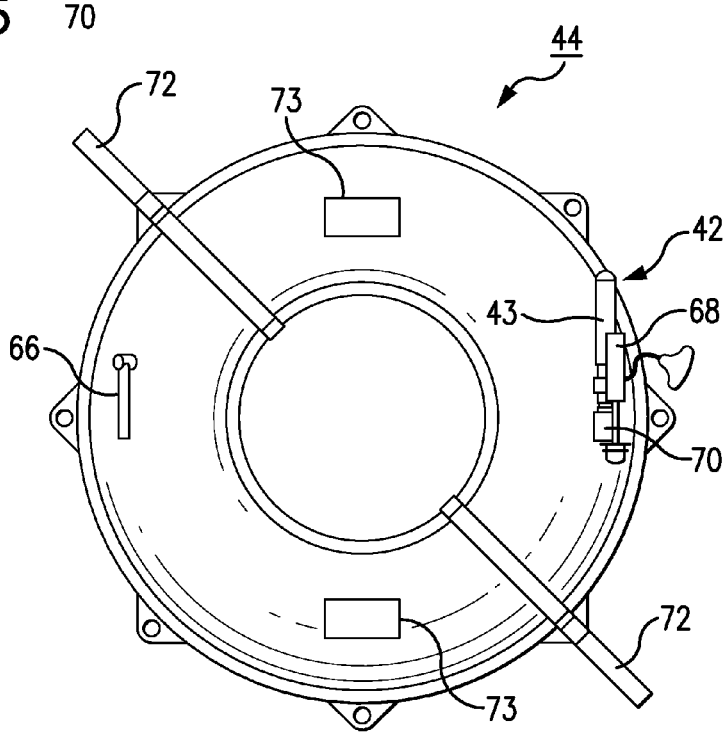
FIG. 6 is a further plan view of the life preserver in its fully inflated state.

A further embodiment of the inflated article 44 is depicted in FIGS. 5 and 6. This embodiment includes a manual inflation valve 66 as well as a water activated strobe light 70. Addition straps 72 can be included about the periphery of article 44 to assist a user in holding onto article 44. Reflective and/or brightly colored tape strips 73 may be adhered to the surface of article 44 to aid in its visibility.

Figure 8:
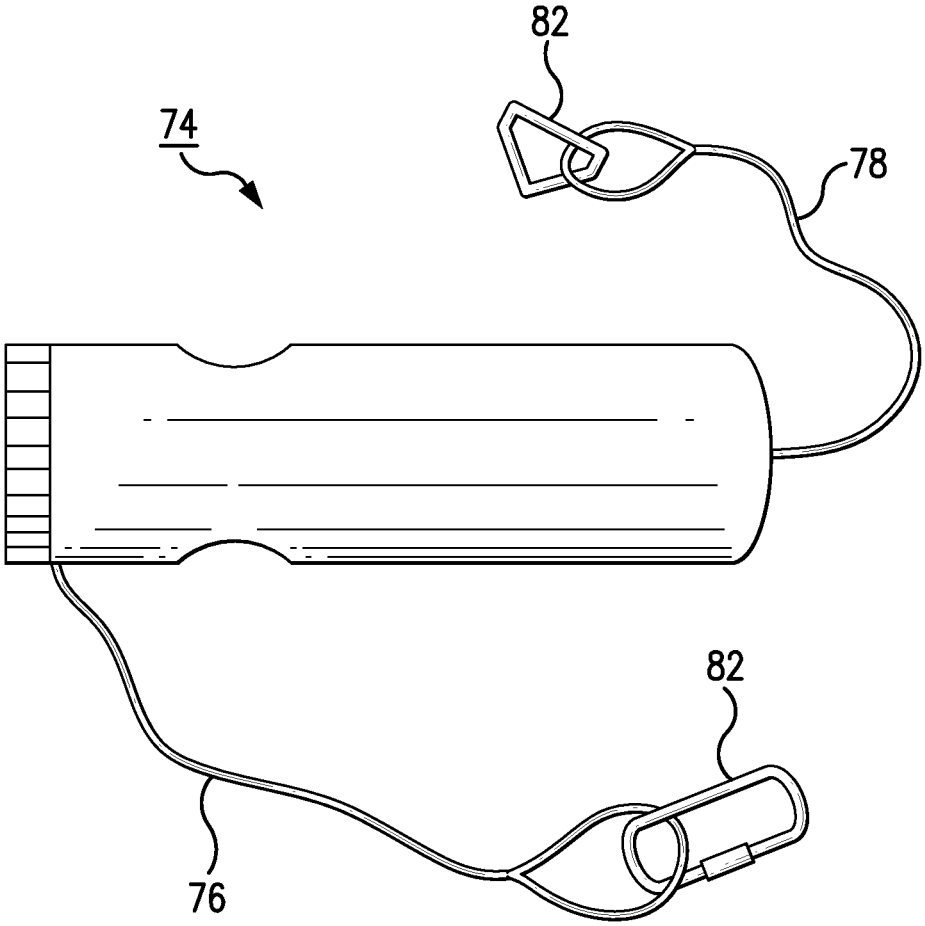
FIG. 8 is a depiction of the rope canister that can be used in connection with the present invention.

FIG. 8 illustrates an optional feature that can be used in connection with the system. FIG. 8 depicts a cord canister 74 that contains a length of coiled rope or cord. One end of the cord is an anchor cord 76 that is designed to be secured to gun 22 via a clip or carabineer 82. In this regard, gun 22 may include a cylindrical sleeve for housing canister 74 and for serving as an anchor point for clip 82. The opposite end of canister 74 includes an opening through which a deployable length of cord 78 can be dispensed. Cord 78 is removably affixed to the inflatable article via a clip or carabineer 82. Thus, via canister 74 a cord is interconnect between gun 22 and article (24 or 52). In this manner, article (24 or 52) can be deployed past a user in distress and pulled back such that it is accessible by the victim.

Thus, after article (24 or 52) enters the water, water will permeate the shrink-wrap 38 or foam tube 54 and come into contact with the pressurized gas release device 42. Once this occurs, the pressurized gas release device 42 senses the water and is thereafter triggered. Once triggered, pressurized gas release device 42 inflates article (24 or 52). Notably, by keeping article (24 or 52) in its uninflated, and packaged, state for as long as possible, article (24 or 52) can be delivered over the maximum possible distance by air gun 22.

The act of inflation ruptures foam tube 54 along score lines 62. The fully inflated configuration 44 of the article in depicted in FIG. 4. This embodiment shows an inflatable ring 44 with six separate hand holds 46. Although a life preserver 44 is depicted, it is possible to package a small life boat or life raft into article (24 or 52) for deployment by gun 22. It is also possible that a floating line may be included on either a preserver or raft with small flotation elements to keep the line on top of the water. The line may be colored in a bright fluorescent color to increase visibility. Additionally, the floating line or the ring may contain attachments such as, but not limited to, a whistle, a mirror, a strobe light, or shark-repellant. The strobe light may be water activated.

This description is of the best mode presently contemplated for carrying out the invention. This description is not to be taken in a limiting sense, but is made merely for the purpose of describing one or more preferred embodiments of the invention. The scope of the invention should be determined with reference to the claim.

What is claimed is:

1. A delivery system for an inflatable article comprising in combination:

a gun including a grip, an enlarged cylindrical bore, and a source of compressed $CO_2$ gas, a trigger for selectively releasing the compressed gas into the bore, a laser light for use in aiming the gun;

a life preserver having an inflated state and an un-inflated state, the life preserver in the inflated state being circular and including a number of hand holds about its periphery;

a layer of water permeable shrink wrap for initially securing the life preserver in its un-inflated state in an aerodynamic, bullet-like configuration;

a water-activated pressurized gas release device interconnected to the life preserver, the gas release device being activated in the presence of water to inflate the life preserver; and a layer of water permeable foam secured between the life preserver in its un-inflated state and the shrink wrap, the foam lessening the impact of the life preserver after being fired from the gun;

the life preserver in its un-inflated state being positioned within the cylindrical bore of the gun with an air-tight seal being formed between the life preserver in its un-inflated state and the cylindrical bore.

2. A rescue system comprising:

a gun including a grip, a cylindrical bore, and a source of compressed gas, a trigger for selectively releasing the compressed gas into the bore;

a water permeable foam cylinder with opposing end caps, score lines and a series of apertures formed within the water permeable foam cylinder; and a deflated article with a water activated gas release device connected thereto, the deflated article being stored within the water permeable foam cylinder;

the water permeable foam cylinder with the deflated article being positioned within the cylindrical bore of the gun with a seal being formed between the water permeable foam cylinder and the cylindrical bore;

whereby the water permeable foam cylinder with the deflated article can be launched from the gun and into the water, water thereafter entering the holes of the water permeable foam cylinder such that the gas release device is triggered to inflate the article and rupture the score lines of the water permeable foam cylinder.

3. The system as described in claim 2 further comprising a laser light for use in aiming the gun.

4. The system as described in claim 2 wherein the article once inflated is a circular life preserver with a number of hand holds about its periphery.

5. The system as described in claim 2 wherein apertures are also included within the end caps.

6. The system as described in claim 2 wherein the water permeable foam cylinder includes an outer mesh layer.

7. The system as described in claim 2 further comprising a strobe light connected to the deflated article.

8. A method for delivering an inflatable article to a person in the water, the method utilizing a gun including a grip, a cylindrical bore, a source of compressed gas, and a trigger for selectively releasing the compressed gas into the bore, the method comprising the following steps:

providing a water permeable foam cylinder with opposing end caps, score lines and a series of apertures formed within the water permeable foam cylinder;

inserting the inflatable article into the water permeable foam cylinder, the inflatable article including a water activated gas-release device;

positioning the water permeable foam cylinder with the deflated article into the cylindrical bore of the gun with a seal being formed between the water permeable foam cylinder and the cylindrical bore; and pulling the trigger of the gun to launch the water permeable foam cylinder with the deflated article towards the person in the water, water thereafter entering the holes of the water permeable foam cylinder such that the gas release device is triggered to inflate the article and rupture the score lines of the water permeable foam cylinder.

* * * * *